United States Patent [19]

Beath et al.

[11] 4,259,148

[45] Mar. 31, 1981

[54] PROCESS FOR MAKING REFINER MECHANICAL PULP

[75] Inventors: Laurence R. Beath; Walter G. Mihelich, both of Kenogami, Canada

[73] Assignee: The Price Company Limited, Quebec, Canada

[21] Appl. No.: 116,852

[22] Filed: Jan. 30, 1980

Related U.S. Application Data

[63] Continuation of Ser. No. 922,528, Jul. 7, 1978, abandoned, which is a continuation of Ser. No. 764,694, Feb. 1, 1977, abandoned.

[30] Foreign Application Priority Data

Feb. 20, 1976 [CA] Canada ..... 246173

[51] Int. Cl.[3] ..... D21C 3/04

[52] U.S. Cl. ..... 162/24; 162/28; 162/38; 162/68; 162/71; 162/83; 162/84; 162/DIG. 2

[58] Field of Search ..... 162/24, 28, 38, 52, 162/56, 68, 83, 84, 86, 90, DIG. 2, 71

[56] References Cited

U.S. PATENT DOCUMENTS

| | | | |
|---|---|---|---|
| 2,198,587 | 4/1940 | Skinner | 162/52 X |
| 2,882,147 | 4/1959 | Davenport et al. | 162/84 X |
| 2,906,659 | 9/1959 | Dorland et al. | 162/83 |
| 2,949,395 | 8/1960 | Von Hazmburg | 162/84 |
| 3,558,428 | 1/1971 | Asplund | 162/86 X |

FOREIGN PATENT DOCUMENTS

| | | |
|---|---|---|
| 517294 | 10/1955 | Canada . |
| 589564 | 12/1959 | Canada . |

*Primary Examiner*—Arthur L. Corbin

*Attorney, Agent, or Firm*—Stevens, Davis, Miller & Mosher

[57] ABSTRACT

A process for making a refiner mechanical pulp from wood chips which comprises:

(a) Comminuting the wood chips largely by splitting along the wood grain;

(b) Wetting said particles with a solution of a sulphite salt of an alkali metal to add an amount of said alkali metal salt within the range of 1% to 10% of the oven dry weight of said particles, said solution having a pH within the range of 7 to 12.5;

(c) Steam heating the sulphite salt solution bearing particles to a temperature within the range between 80° C. and 165° C. and holding them within that temperature range for a period of 0.5 to 80 minutes;

(d) Passing the particles, after said period of heating, through a disc refiner to produce refiner mechanical pulp.

30 Claims, 10 Drawing Figures

PROCESS FOR MAKING REFINER MECHANICAL PULP

This is a continuation of application Ser. No. 922,528, filed July 7, 1978, now abandoned, which in turn is a continuation of application Ser. No. 764,694, filed Feb. 1, 1977, now abandoned.

This invention relates to a process for the manufacture of mechanical (groundwood type) pulps by the use of disc refiners. In this well known process, wood chips are fed between the surfaces of opposed, closely spaced, relatively rotating discs. There, by a complex action of impact, abrasion and cutting, the chips are comminuted into separated fibres and fragments thereof to produce a pulp of commercially useful properties. Such pulps, made from softwood chips, are finding increasing use in the manufacture of newsprint. In addition to wood chips wood wastes, such as sawdust or planer mill shavings, may also be used to make similar pulps but of lower quality.

Pulps properly made from softwood chips by refiners have superior properties to those made from the same wood species by the older process of grinding logs against a rotating abrasive grindstone. This superiority of refiner mechanical pulp permits newsprint manufacture with a reduced proportion of the stronger, and much more expensive, chemical pulp used to increase both the wet and dry strengths of the pulp blend so that it will run with an acceptably low number of web breaks both on the paper machine where it is made and on the printing press where it is used. Newsprint has, in the past, been made from refiner mechanical pulp without addition of chemical pulp. However, in more recent years, paper machine speeds have increased, and newsprint quality levels risen so that a 100% refiner mechanical pulp newsprint is no longer considered commercially competitive.

It is, therefore, a major objective of our invention to provide an improved process by which refiner mechanical pulp can be made having wet and dry strength properties so improved that competitive quality newsprint can be made from it without addition of chemical pulp. It is further objective of our invention to provide a process by which such pulp can be made at about the same high yield as is obtained in the conventional refiner mechanical pulping process. It is also an objective of our process to substantially increase the quality of the pulps which can be made from sawdust, and from planar shavings, thereby permitting wider use of these less expensive and currently largely wasted raw materials. Another purpose of our process is to produce a brighter pulp without use of bleaching chemicals than can be made from a given wood by the conventional refiner mechanical pulping process. Other important advantages in product quality are given by our process, as compared to conventional refiner mechanical pulping. Pulps from our process at a given degree of refining (freeness) have a much lower content of debris and shives and are lower in bulk. The relatively high bulk of refiner mechanical pulps is an adverse factor in that rolls of newsprint made largely from such pulp contain, at a given diameter, a lesser yardage of paper. It is an important aspect of our invention that the cited objectives can be obtained by relatively simple and inexpensive modifications to conventional refiner mechanical pulping systems.

The present invention therefor provides a process for making an improved refiner mechanical pulp from wood particles which comprises:

Wetting said particles with a solution of a sulphite salt of an alkali to add an amount of said alkali salt within the range of 1% to 10% of the oven dry weight of said particles, said solution having a pH within the range of 7 to 12.5;

Steam heating the sulphite solution bearing particles to a temperature within the range between 80° C. and 165° C. and holding them within that temperature range for a period of 0.5 to 80 minutes;

Passing the particles after the said period of heating through a disc refiner to produce refiner mechanical pulp.

In a preferred embodiment the present invention provides a process for making an improved refiner mechanical pulp from wood chips which comprises:

(a) Comminuting the wood chips largely by splitting along the wood grain to make smaller particles;

(b) Wetting said particles with a solution of a sulphite salt of an alkali to add an amount of said alkali salt within the range of 1% to 10% of the oven dry weight of said particles, said solution having a pH within the range of 7 to 12.5;

(c) Steam heating the sulphite solution bearing particles to a temperature within the range between 80° C. and 165° C. and holding them within that temperature range for a period of 0.5 to 80 minutes.

(d) Passing the particles after the said period of heating through a disc refiner to produce refiner mechanical pulp.

The sulphite salt is preferably an alkali metal salt, most preferably sodium sulphite. The wood chips are preferably split predominantly into particles having dimensions in the cross grain direction of not over four millimetres.

In one aspect the present invention provides such a process for making an improved refiner mechanical pulp from wood chips which comprises:

(a) Comminuting the wood chips largely by splitting along the wood grain to make smaller particles;

(b) Wetting said particles with a solution of a sulphite salt of an alkali to add an amount of said alkali salt within the range of 1% to 10% of the oven dry weight of said particles, said solution having a pH within the range of 7 to 12.5;

(c) Steam heating the sulphite solution bearing particles to a temperature within the range between 80° C. and 100° C. and holding them within that temperature range for a period of about 2 to 80 minutes, but normally over 5 minutes;

(d) Passing the particles after the said period of heating through a disc refiner to produce refiner mechanical pulp.

In other aspects the time of heating may be 10 to 80 minutes, or in certain cases 15 to 80 minutes.

In a preferred embodiment of this aspect the elevated temperature range is 85° to 100° C., and is held for about 30 minutes. It may be desirable to carry out this embodiment such that both the cooking and refining steps are carried out at atmospheric pressure. The sulfite salt is preferably added in an amount in the range of 2 to 10% (or more preferably 2 to 8%) of the oven dry weight of the chips. Most preferred is 2 to 4% by weight.

In one embodiment the sulphite solution draining from the chips during the heating period is separated from the heated chips and fortified with concentrated sulphite solution for use in treating further chips. Cooling water may be added to the particles after the heating step and before passing the particles through the refiner.

In another aspect the present invention provides such a process for making an improved refiner mechanical pulp from wood chips which comprises:

(a) Comminuting the wood chips largely by splitting along the wood grain predominantly into particles having dimensions in the cross gain direction of not over four millimetres;

(b) Wetting said particles with a solution of a sulphite salt of an alkali to add an amount of said alkali salt within the range of 1% to 10% of the oven dry weight of said particles, said solution having a pH within the range of 7 to 12.5;

(c) Steam heating the sulphite solution bearing particles under superatmospheric pressure to a temperature within the range between 125° C. and 165° C. and holding them within that temperature range for a period of 0.5 to 20 minutes;

(d) Passing the particles after the said period of heating through a disc refiner to produce refiner mechanical pulp.

In preferred embodiments of this aspect when the cross grain direction of the particles is not over four millimetres the elevated temperature and pressure will preferably be held for 0.5 to 5 minutes and most preferably about 2 minutes.

In the practice of this invention the preferred pH of the sulphite salt solution is about 12, when sodium hydroxide is added to the sulfite solution.

In the drawings which form a part of this specification:

FIG. 1 is a flow sheet showing the processes.

FIG. 2 gives burst factor and debris content of pulp made by the present process at about 100° C., with varied heating times.

Figure 1:
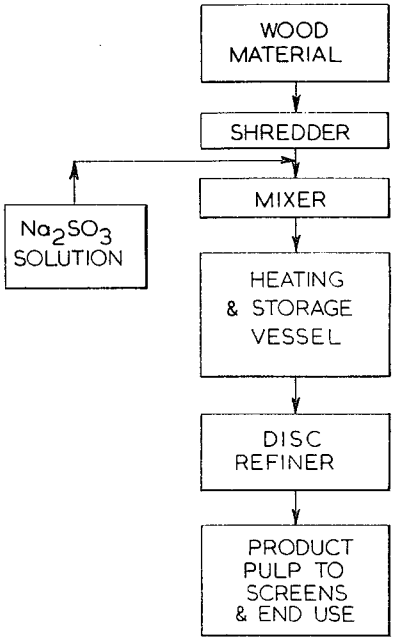
FIG. 1 is a flow sheet showing, in principle, the broad elements of the process of our invention by which the specific conditions used are able to realize the stated objectives.

Wood material, preferably softwood chips for optimum product quality, is passed through a chip shredder in which it is reduced to coarse slivers. The shredded material then drops into a mixer (which can be a screw conveyor) where a strong solution of sodium sulphite ($Na_2SO_3$) is added to the wood substance in a manner giving essentially uniform distribution of the solution on the wood. Alternatively, the sodium sulphite may be added to the chips at the shredder where intense agitation assures good dispersion of the solution over the wood particle surfaces. The wood and chemical mixture then passes into a heating and storage vessel to which steam is added to bring the contents to the desired temperature and in which the heated mixture is retained for the time needed to get optimum effect from the heating. After a suitable holding time, the hot wood substance is withdrawn and fed to a disc refiner where it is converted into pulp of the desired properties.

The benefits of our process, most importantly higher wet and dry strengths relative to pulps made by the conventional refiner mechanical pulping process, are also obtained when our process is used with raw materials other than softwood chips. Sawdust is used for making refiner mechanical pulps: The quality of such pulps is always substantially below that of pulps made from the same wood species in chip form and varies with the coarsenness of the sawdust—coarser sawdust making better pulp. When sawdust is pulped by our process, the proportionate increase in product quality, over that of refiner mechanical pulp made from the same material, is essentially the same as the proportional improvement obtained with chips. Similar proportionate increases are obtained by the use of our process on other raw materials such as softwood planer shavings or chips from such hardwood species as birch and aspen. These proportionate increases, using bursting strength at a given freeness as an index, are in the range from about 50% to 100%, or more, relative to regular refiner mechanical pulp. Such increases are of an important magnitude and substantially upgrade the economic value of the pulps which can be made from these materials and thus increase the number of paper products in which they may be used. Unlike other processes by which similar proportionate increases in quality may be had, our process gives these increases with very little loss of pulp yield relative to the conventional refiner mechanical pulping process.

One step in the process of our invention is the addition of sodium sulphite to the wood substance. The addition of sodium sulphite to wood substance from which mechanical pulp is to be made by disc refining is not in itself novel. Such prior use has not involved the particular combination of conditions which constitute our invention, and has not given the very favorable results of our process. Good results are obtained in our process when the rate of addition of sodium sulphite is in the range of 1% to 10% of oven dry weight of the wood substance. The sodium sulphite may be added to the wood substance by dipping the wood into a solution of sodium sulphite or by spraying the solution on it. Uniform coverage of the wood surface is desirable. The sodium sulphite solution may be prepared by dissolving the solid salt. In this case, solutions of up to aboutt 20% sodium sulphite concentration may be made using water at room temperature. If, as may happen, our process is to be used in pulp and paper mill in which chemical pulp is being made by a sodium base sulphite cooking process, the sodium sulphite solution used in our process may most conveniently and cheaply be obtained by adding sodium hydroxide to the cooking liquor in the proportion needed to convert the salt to sulphite. In this case, sulphite solutions of 8–10% concentration will result.

When wood chips are used in our process, only a limited amount of sodium sulphite solution can adhere to the chip surfaces; any quantity added to the chips in excess of this limited amount drains off. The limited water holding capacity of the chip surfaces makes it necessary to use sodium sulphite solutions of high concentration in order to retain the needed amount of sodium sulphite after any drain-off has occured. This factor closes the desirable option of using the less expensive, lower concentration, sodium sulphite solution made, as described above, from cooking liquor. Furthermore, in the subsequent stage of our process in which the chips are steamed, steam condensate forms on the chips, mixes with and dilutes the sodium sulphite solution and, because of the limited liquid holding capacity of the chip surfaces, results in the dripping off of some of the sulphite solution.

In a preferred embodiment of our process, we shred the chips before adding to them the required sodium sulphite solution. Shredding greatly increases the total surface area of the wood substance and increases in like proportion the amount of solution which can be held by the wood surface. This improved liquid holding capacity of the wood substance due to the surface area increase resulting from shredding is further increased by a greatly increased number of contact points between wood fragments, each of which contact points constitute locations at which solution menisci can form, thereby holding solution additional to that on other areas of the surfaces of the particles.

We have measured the amount of water which can be held by the surface of softwood chips and find it to be in the range 0.35 to 0.40 pounds per pound of oven dry wood substance. The same type of chips after shredding in a preferred way will hold 1.15 to 1.20 pounds per pound of wood substance. The water holding capacity of chips is about the same as the amount of high concentration sodium sulphite solution which may be used in our process at the higher rates of addition of this chemical.

It is also about the same as the amount of steam condensate which will form on the chips in the heating stage of the process. The steam plus chemical solution will then, in sum, exceed the volume which can be held by the chip surface, and condensate-diluted chemical solution will drain off.

Our process may be used with unshredded chips. However, if unshredded chips are used, part of the sodium sulphite will, as noted, wash off in the steaming stage. In a large plant for the use of our process, the value of the washed off sodium sulphite will be substantial and its recovery important. It will therefore by necessary to provide means which will separate this washed off solution from the chips before they go to the refiner and means to fortify it to its original concentration for reuse. It is an important result of our preferred embodiment in which the chips are shredded, that the operating and capital costs of so recycling sodium sulphite solution are eliminated.

A further advantage of the preferred embodiment in which the chips are shredded is the lesser distance which the sodium sulphite must diffuse to reach the fibres most remote from the surface of the wood particles. The lesser distance results in more uniform distribution of the chemical among the fibres and thus gives improved pulp quality.

The chip shredding step may be done by any suitable comminuting machine in which particle size reduction is effected predominantly by splitting the wood particles along their grain direction with a minimum of cross grain fractures which reduce fibre length and potential pulp quality. Shredding may be done by a hammermill or a disc type attrition mill; a preferred type of disc attrition mill is the chip Fractionator as manufactured by Sprout Waldron Inc. Chip shredding can be done with the Fractionator with an energy consumption of about 0.4 to 1.0 horsepower days per ton.

Another method by which chips can be conditioned to absorb chemical solution is the use of a very heavy duty screw press, such as the Bauer Impressafiner. This machine compresses chips and partially breaks down their structure to render them flexible. It also provides means by which, as the chips are being released from compression, they are immersed in a treating chemical solution which they can imbibe as they elastically expand on release of compression. Such screw presses are large and expensive units and require considerable maintenance as a result of wear caused by the very high frictional forces between the compressed chips and the machine parts. Energy consumption is fairly high, in the range of 5 horsepower days per oven dry ton of chips processed.

The shredding of chips gives a range of particle sizes in the product. We prefer, in the shredding step, to reduce the chips to a shredded mass in which most of the particles are in the size range having dimensions across the wood grain of the order of 1 to 4 millimeters but it will be understood that a few particles may be more than 4 millimeters in the cross grain direction and many will be smaller than one millimeter.

The degree of shredding suitable for our process can be expressed by the relative water holding capacity of the original chips and their shredded product. Water holding capacity for chips and shredded chips is measured by: (1) placing a weighed sample of chips (or shredded chips) in a tared, wire mesh basket; (2) immersing the filled basket in water for 30 seconds; (3) removing the basket from the water and shaking it to remove drainable water from the contents; (4) weighing the basket and contents to determine the amount of added water retained; (5) oven drying the chips (or shredded chips) to determine the oven dry weight of wood substance; (6) calculating the added water retained as a fraction of the oven dry weight of the wood substance. For best results in the process of our invention, we prefer that the shredding process be so done as to give the shredded chips a water retaining capacity which is 60% to 300% greater than the water retaining capacity of the original chips. Below the 60% increase, there is hazard of wash-off of chemical in the steaming step as already explained. At high percentage increases in water holding capacity, there is loss of final product quality due to fibre damage from excessive shredder action.

In one test of the effect of degree of shredding on final product quality, a lot of chips was divided into two portions. One portion was shredded by a single pass through an attrition mill. The second was similarly shredded and the shredded material passed twice more through the attrition mill to get a finer shredded product. Single pass and triple pass products where then given identical further processing according to our invention. The final pulps produced had the following properties, at equal freeness of 100, given in Table I.

TABLE I

| | Single Pass Shredding | Triple Pass Shredding |
|---|---|---|
| Burst factor | 28.2 | 23.8 |
| Bulk, ml/gm | 2.62 | 2.72 |
| Debris content, % | 0.51 | 0.90 |

Triple pass shredding has obviously been excessive, causing strength loss and an increase in the shive content of the final product. Degree of shredding is therefore an important factor in that embodiment of our invention which includes a shredding step.

FIG. 1 shows, as one element used in our process, a mixer. This element is used to mix together the wood substance being processed with the sodium sulphite solution. Various types of units are suitable for doing this function. A simple and satisfactory one is a regular screw conveyor provided with one or more spray nozzles by which sodium sulphite solution may be sprayed upon the chips while they travel along the screw which increases the stirring effect and promotes uniform distribution of solution on the wood surfaces. Wood particles are often conveyed by air and, at their destination, are separated from the air stream by a cyclone separator from which they exit by spiralling down a drop leg; sulphite solution can be conveniently added by spraying it on the wood particles as they spiral down the wall of the drop leg. Solution addition can also be effected by simple dipping of the wood particles into the solution, followed by draining. This mode of addition can be had in a continuous flow system if wood particles and solution are added to the lower end of an inclined screw conveyor in which the solution forms a pool at the lower end and from which pool the screw lifts the wood particles while excess solution drains back into the pool.

The proportion of sodium sulphite added to the wood in the practice of our invention is an important factor in the quality of the pulp produced. Product pulp quality can be varied by adjusting the proportion of sodium sulphite to wood. It is thereby possible to make pulps having, for any given end use, an optimum balance between their strength properties (which improve with an increasing proportion of sodium sulphite) and their costs which also increase with increasing proportions of sodium sulphite.

Figure 10:
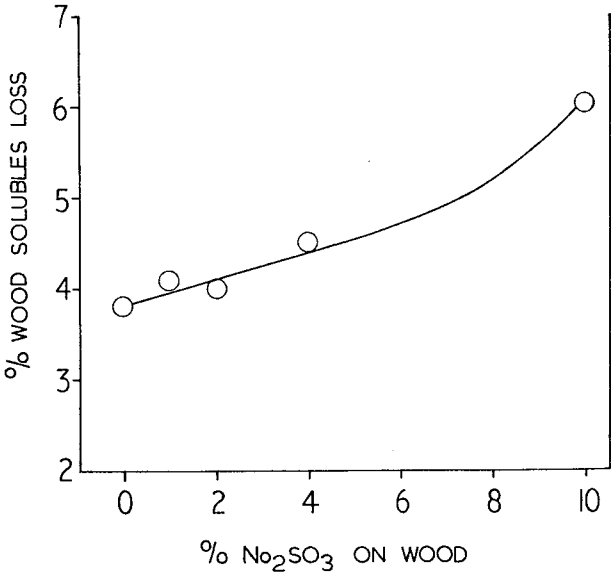
FIGS. 8 to 10 are graphs which show the effects of sodium sulfite content on debris content, burst factor, and wood solubles loss percent.
Figure 9:
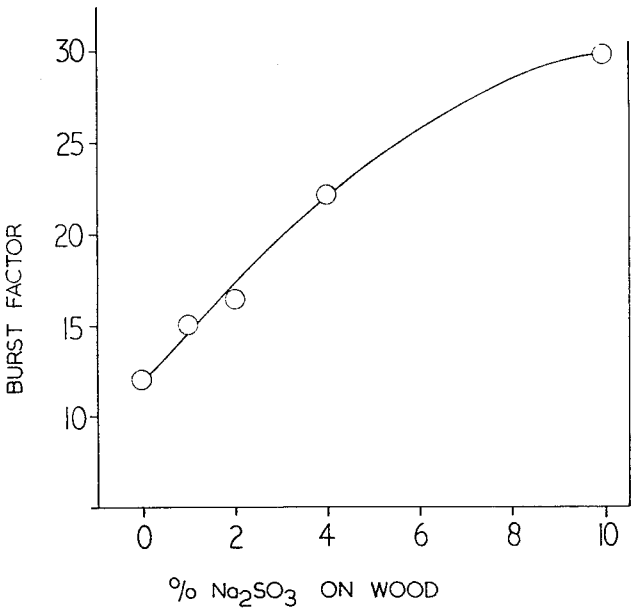
Figure 8:
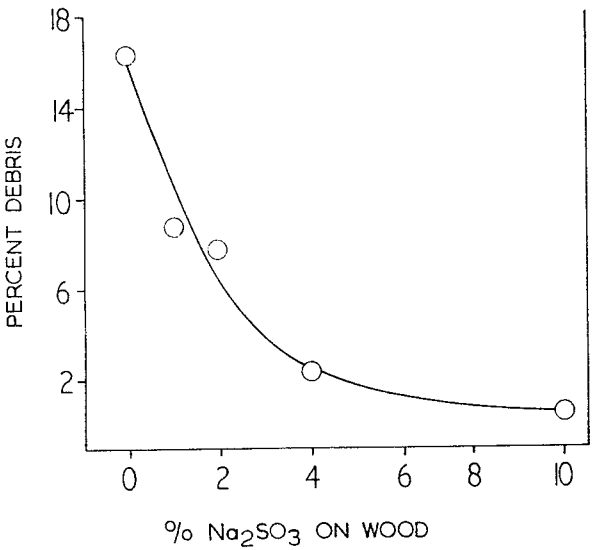

FIGS. 8, 9, and 10 present data for a series of pulps made by the process of our invention in which only the proportion of sodium sulphite to wood was changed. The common processing steps for each level of sodium sulphite addition were: 2000 oven dry grams of spruce-balsam chips were shredded; these were sprayed with one litre of a solution of sodium sulphite; sprayed material was steamed for 30 minutes at atmospheric pressure; steamed material was disc refined by multiple passes to yield for testing four pulps spanning an appropriate freeness range. The sodium sulphite solutions had the appropriate concentrations to provide 1%, 2%, 4% and 10% of sodium sulphite to the respective lots of shredded chips to which they were applied. The solutions had pH's of about 8.9. Another 2000 gram lot of shredded chips was disc refined without sodium sulphite addition or steaming to provide a conventional refiner mechanical pulp as a base for comparison. The properties of this pulp are plotted in FIGS. 8, 9, and 10 at the 0% sodium sulphite point.

FIG. 8 is a plot of debris content of the pulps, interpolated to 100 freeness, as a function of the percentage of sodium sulphite added to the wood. It will be seen that even a 1% addition of sodium sulphite, in combination with the other conditions of our process, has effected about a 50% reduction in debris content relative to the pulp made by the conventional refiner mechanical pulping process. Increasing proportions of sodium sulphite further reduce debris content: at a 10% rate of sulphite addition the debris has been reduced by a factor of more than 30 relative to the refiner mechanical pulp. The shape of the curve of FIG. 8 clearly shows that, because shive content is already very low, sodium sulphite addition rates higher than 10% could only effect a slight further reduction in debris content. Sodium sulphite addition rates above 10% are not economically justified on the basis of shive content reduction.

FIG. 9 is a similar plot showing the effect of proportion of sodium sulphite on the burst factor of 100 freeness pulps. The use of 1% sodium sulphite in our process has increased the burst factor by 25%, and 4% sodium sulfite almost doubles it. A still further strength increase occurs as the proportion of sodium sulphite is increased to 10%. However, the strength increment per increased 1% of sodium sulphite is diminishing as the total sulphite addition gets towards the 10%.

When mechanical pulps are made there is always some yield loss due to release of water solubles from the wood. Similar loss occurs in pulping wood by our process and these losses increase with the amount of sodium sulphite used. The loss is the percentage difference between the weight of dry wood substance entering the process and dry product pulp after washing free of soluble substances. In FIG. 10 such losses are shown for pulps made by our process using sodium sulphite addition rates of 1% to 10% and, plotted at the 0% point of the sodium sulphite scale, for conventional refiner mechanical pulp. It will be seen that there is very little added loss by our process, relative to the refiner mechanical process, at sulphite addition rates up to 4%. The shrinkage is 3.8% for refiner mechanical pulping and 4.5% by our process when using 4% sodium sulphite. At 10% sodium sulphite addition rate, the shrinkage has increased to 6% and is obviously increasing more rapidly than the increase in rate of addition of sodium sulphite.

The diminishing response in burst factor increase and debris content reduction, and the rising raw material cost represented by increasing yield loss and quantity of sodium sulphite, will usually place an economic upper limit of about 10% on the proportion of sodium sulphite used. We may therefore, in the practice of our invention, use from 1% to 10% of sodium sulphite (based on oven dry wood), according to the quality of pulp desired. A preferred range of sodium sulphite addition will be in the range of 2% to 4%.

As stated earlier, if whole chips are used and sodium sulphite solution strength is low, the chips may not be able to retain all the added sulphite solution plus the condensate formed on the chips on heating. In such case, the proportion of sodium sulphite added to the chips must be in excess of the amount which it is desired to have available in the thermal reaction stage and it will be necessary to add substantially more chemical than stated above. The extra added chemical washed off by steam condensate may be separated from the chips, fortified with more sodium sulphite and reused.

Although we have largely referred to sodium sulphite as the chemical used in our process, potassium sulphite may also be used. Ammonium sulphite solutions are not suitable for use in our process. They give much lesser pulp strength increments than do sodium sulphite solutions and cause a reduction in pulp brightness. When the solutions are made by dissolving a sulphite salt, they will ordinarily have pH in the range of 8 to 10. If the solutions are made by the addition of a solution of a base to a solution of bisulphite, as may be done when bisulphite cooking liquor is used as a source of sulphur, the final pH of the solution will largely by a function of the sodium: sulphur atomic ratio. It will be understood that the family of solutions made from sodium hydroxide and sulphur dioxide constitute a broad continuous spectrum containing, at different ratios of sodium to sulphur, various proportions of the following ions: hydrogen, sodium, bisulphite, sulphite and hydroxyl. The proportions of the various ions, result in a solution pH characteristic of that proportion. Solution pH is therefore a simple, convenient method of characterizing such solutions as to their sodium: sulphur ratio, and identifying the particular portion of the spectrum in which a given solution is located. The solutions suitable for use in our process are those in which a high proportion of the anions are sulphite and a modest proportion are hydroxyl and bisulphite. Such solutions will have pH values in the range between 7 and 12.5. The sulphite solutions made with sodium hydroxide and suitable for use in our process can therefore be characterized as those having pH values in the range 7 to 12.5.

The pH values to which we refer herein are measured according to normal industrial practice using a glass electrode pH meter calibrated against standard buffer solutions, with the measurements corrected to 25° C. The electrodes used for the pH measurements herein referred to are, in combination, a Beckman General Purpose Electrode (trademark) No. 41263 and a Beckman Fibre Junction Reference electrode (trademark) No. 39170.

It is known that pH measurements made in this way, customary in industrial practice, may depart from the values which would be obtained using the strictest scientific procedures for determining absolute pH. The departures from the soundest scientific pH values resulting from commercial practice measurements are a complex function of the sodium ion concentration of the solution being tested, of the temperature at which the measurement is made, and of the properties of the glass electrode used for measuring. To avoid these complexities pH values are expressed throughout the present specification in terms of the procedure and electrodes described.

Thus for example the upper limit of 12.5 as measured herein was determined to be actually about 13.7, when allowance was made for this factor, sometimes called the "sodium ion concentration effect." Fortunately this effect is significant only near the top part of the pH range. It appears to be negligible below pH about 10.5 to 11.

Although, strictly speaking, sodium sulphite solutions are only these containing sodium, sulphur and oxygen in the proportions corresponding to the formula $Na_2SO_3$, we use the term sodium sulphite solutions to embrace other solutions containing other than the stoichometric proportions of sodium to sulphur and which give solutions having pH's in the range of 7 to 12.5. Similarly, for other alkali sulphites, we use the term alkali sulphite solutions to comprehend solutions which are primarily sulphite solutions but which have alkali: sulphur ratios which result in solutions of pH in the range 7 to 12.5.

The effect of the sodium hydroxide to sulphur dioxide ratios of the treating solutions applied was investigated in a series of tests. A large sample of chips was shredded and aliquots of the shredded chips were treated according to our process except that some of the aliquots had added to them treating liquors with pH's (sodium - sulphur ratios) outside of the range of our invention to demonstrate the uniquely distinctive effects of the pH range of treating liquors which constitutes a part of our invention.

A series of solutions were prepared which all contained 7.6% sulphur dioxide together with amounts of sodium hydroxide which varied among solutions. These solutions had pH values ranging from 3.7 to 13.0 and thus covered the range from a solution which was composed essentially of dissolved sodium bisulphite through a solution essentially of sodium sulphite and finally to a solution of sodium sulphite with a substantial amount of free sodium hydroxide. Each aliquot of shredded chips was sprayed with a solution of different pH in an amount which gave a constant addition of sulphur dioxide of 3.8% of the oven dry weight of wood substance. These were further processed in identical fashion by first steaming for 30 minutes at 100° C. and then by difibering in a laboratory disc refiner to several degrees for each aliquot. Pulps so made were tested for a number of properties; test values of the individual pulps were plotted against their freeness and test values to be expected at 100 freeness were obtained by interpolation from such plots. Several such test values at 100 freeness for the various aliquots are plotted in FIGS. 4, 5, 6, and 7 as a function of the pH of the liquors with which they had been treated. Also shown in the figures, as horizontal lines marked RMP, are the test values obtained for an aliquot of shredded chips which was refined without use of the chemical addition and steaming steps of our process—a standard refiner mechanical pulp.

Figure 4:
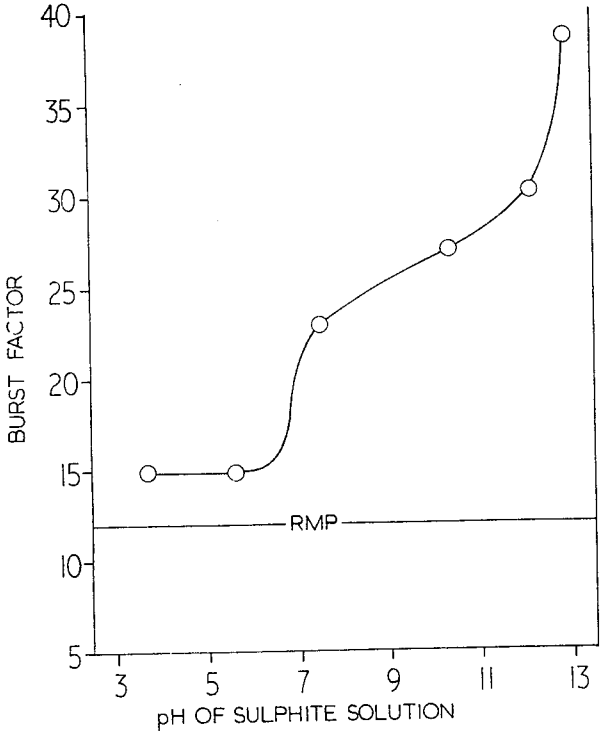

FIG. 4 shows the burst factors of 100 freeness pulps so made plotted against the pH's of the liquors applied to the various aliquots. It will be seen that the standard refiner mechanical pulp had a burst factor of 12. When the process of our invention was followed, except that the pH of the sulphite solutions were 3.7 and 5.6 and hence below the pH range we specify, the burst factors obtained were only 14.8. The third point on the curve represents a pulp made with a liquor of 7.5 pH, just within the lower bound of our specified pH. Here, burst factor was 22.9. It is apparent that the pH of the treating solution is critical in its effect on pulp strength and that moving from pH 5.6 to pH 7.5 for the sulphite solution has greatly enhanced the pulp strength. There is thus a qualitative change in the mode of action, and in the results produced, by the use of sodium sulphite solutions having pH values of about 7 as against solutions of about 5.6 pH and lower. Higher burst factors of 26.8 and 30.2 were obtained at pH's of 10.4 and 12.2 respectively. A further abrupt rise of burst factor to 38.7 was obtained at pH 13.0. While this higher burst factor is, by itself, very desirable, other property changes to be described occur in the 12.2 to 13.0 pH range which are adverse and we therefore specify an upper pH limit of 12.5 for our process.

Figure 5:
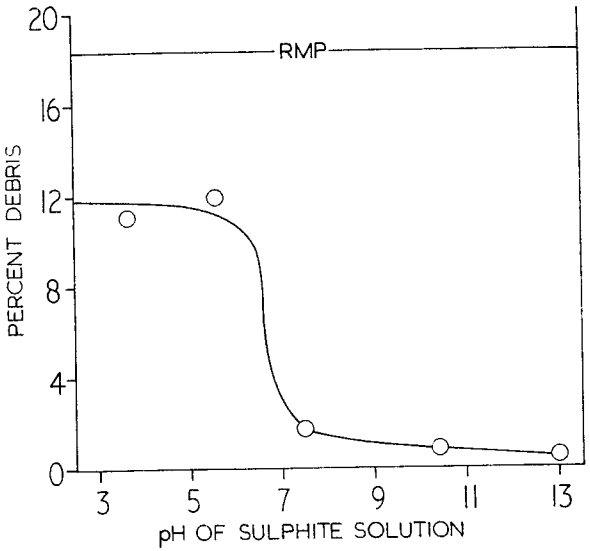
FIGS. 4 to 7 show graphs of the effect of pH on burst factor, debris content, brightness percent and pulp yield percent for some examples.

FIG. 5 shows the debris, or shive, content obtained by interpolation for 100 freeness pulps as plotted against pH of the treating solution for the pulps prepared as described above. Also shown is the corresponding value for the conventional refiner mechanical pulp made without addition of chemical and without steaming. The debris contents are the proportions of each pulp, as percentages, which are too large to pass screen slots of 0.006 inch width and represent an undesirable fraction which must be removed for further size reduction. The refiner mechanical pulp had over 18% debris at 100 freeness. Application of sulphite solutions of 3.7 and 5.6 pH, plus steaming, reduced the debris content to 11.0 and 12.0% respectively, a modest improvement. When the sulphite solution applied was 7.5 pH, the debris content was only 1.7%, less than 10% of the debris content of the conventional pulp and only 15.5% as much as was in the better of the two pulps made by identical treatment except that the solutions used were lower in pH than those used in our invention. The other points on the curve of FIG. 5 show still further small, but significant reductions in debris content as pH of the treating solutions is further increased to 13. Again, there is clearly a major improvement in product quality, here shown by reduced debris content, associated with the use of solutions of pH about and above 7. The small disc refiner used in making this series of pulps characteristically produces a high debris content relative to larger commercial units. However, since all pulps were made on the same refiner, the major reduction in the proportion of debris achieved by the conditions of our process properly reflects the advantage of our process in this respect.

Figure 6:
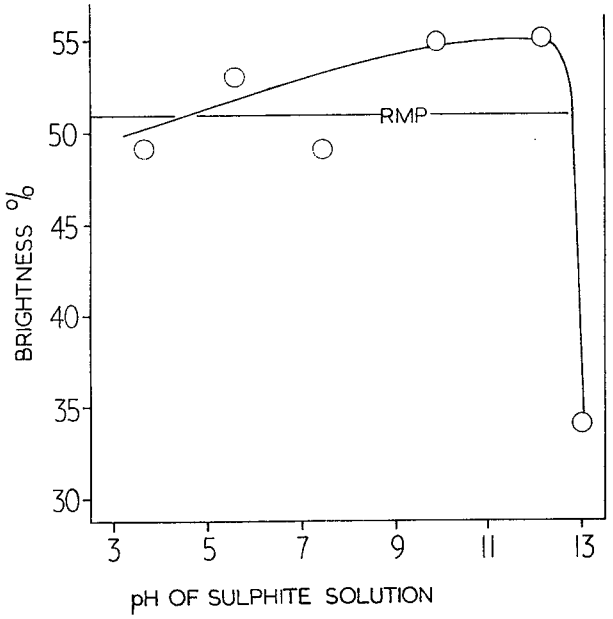

FIG. 6 is a plot of pulp brightness at 100 freeness obtained, as before, by plotting and interpolation of test data for the pulps made by treatment with solutions of various pH's. The graph shows a possible, small indication of increasing brightness with increasing pH of the treating solution in the range 3.7 to 12.2.

Between 12.2 and 13 pH there is a clear and very large decrease in brightness. The pulp made with the 13 pH liquor is much too low in brightness for use in the more important products in which mechanical pulp is used. We therefore specify that the pH of the sulphite liquor used in our process should not have a pH higher than 12.5 to avoid the abrupt drop in brightness which occurs at higher pH's.

Figure 7:
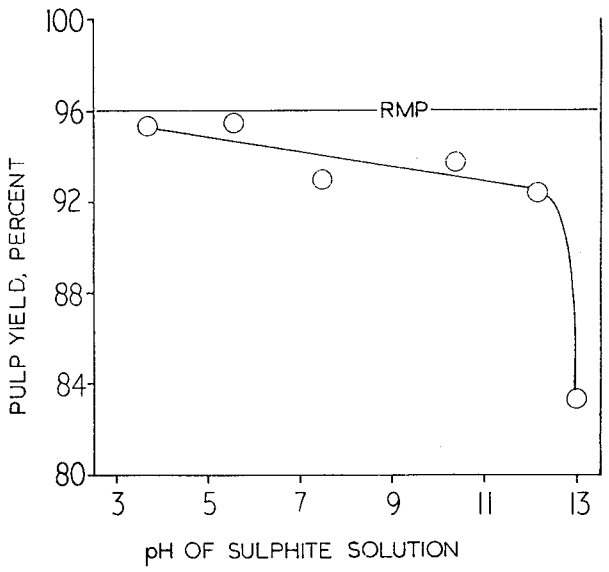

FIG. 7 is a plot of the pulp yield after hot water washing as a percentage of the original wood substance entering the process. Again, the variable affecting yield is the pH of the liquor used. The yield decreases slowly with increasing pH of the treating liquor. Relative to the 96.2% yield of the conventional refiner mechanical pulp, the yield for pulps made with sulphite solutions decrease slowly to a tolerable 92.4% for a solution pH of 12.2. When the pH was further increased to 13, yield decreased greatly, dropping to 83.3%. Thus, a major and undesirable change in yield occurs in the span of pH of treating liquor between 12.2 and 13.0.

From the foregoing it will be clear that the markedly good results obtained by the process of our invention are obtained only when the pH of the sulphite solutions used exceeds about 7 and that unwanted, adverse pulp properties result if the solution pH is somewhat above 12.2. The unique and desirable results of the process of our invention are only obtained when the sulphite solutions used have their pH's in the range from about 7 to about 12.5. Because undesirable pulp quality changes result with pH's above or below this range, and because perfect pH control is seldom possible in industrial circumstances, and because pulp qualities improve with rising pH up to at least 12.2 pH, we use solutions with pH's in the 10.5 to 11.5 range whereby in our preferred embodiments nearoptimum quality can be had while the hazard of getting the adverse results consequent on a pH of 13 are minimized.

Sodium sulphite solutions may also be made by the addition of sulphur dioxide to solutions of sodium carbonate. When a sodium sulphite solution is so made and has a sodium to sulphur ratio of 2, the solution is essentially the same as results, at the same ratio, from the addition of sulphur dioxide to a sodium hydroxide solution. At sodium to sulphur ratios exceeding 2, excess base will be present as sodium carbonate rather than sodium hydroxide. We have determined that such excess sodium carbonate has the same effects in our process as does an equivalent excess of sodium hydroxide and therefore include such solutions in the term sodium sulphite solutions as before defined.

Sodium carbonate, if present in sodium sulphite solutions in excess of the amount needed to give a sodium to sulphur ratio greater than 2, increase the solution pH as does sodium hydroxide. The effects of such excess upon the properties of pulps made by our process are essentially identical to those resulting from a like excess of sodium hydroxide as described in the preceding 6 paragraphs. Too great an excess of sodium carbonate has the same effects as too great an excess of sodium hydroxide, causing loss of brightness and yield.

As sodium carbonate is a less basic substance than sodium hydroxide, excess sodium carbonate gives sodium sulphite solutions of lower pH than does a chemically equivalent excess of sodium hydroxide. We have found that the adverse effects of too great an excess of sodium carbonate occur at pH levels of above 10 rather than above about 12.5 as is the case with sodium hydroxide.

Following the addition of sodium sulphite to the wood particles, the mixture is subjected to a thermal reaction stage in which a substantial proportion of the sulphur in the sodium sulphite is chemically reacted with the lignin of the wood substance to form in situ an insoluble lignin sulphonate. It is a major advantage and novelty of our process that the thermal reaction stage can be effected using very mild conditions which can be obtained on commercial scale by simple and inexpensive means.

Figure 2:
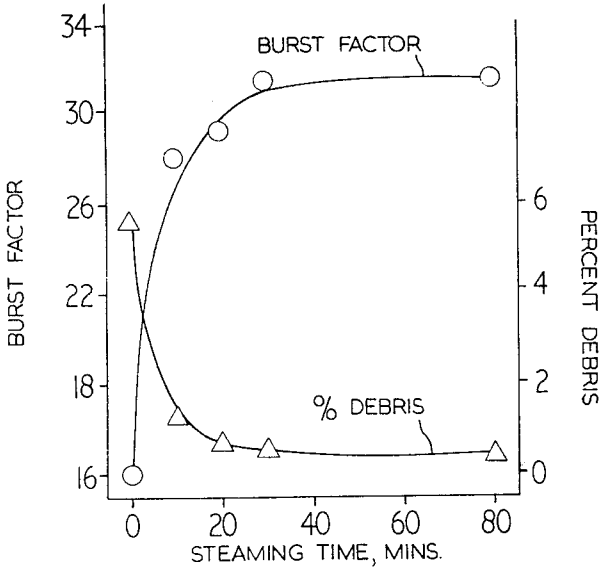

In a preferred embodiment of our invention, the sulphite treated wood particles are placed in an open vessel and steam is added directly to the contents to bring their temperature up to 90° to 100° C. The contents are maintained in this temperature range for about 30 minutes after which they are passed through a disc refiner to produce the improved pulp of our process. The time for which the sulphite treated wood particles are held near 100° C. is not critical. Properties of the product pulp improve with increasing time of heating up to about 30 minutes and are essentially unchanged thereafter. FIG. 2 gives burst factor and debris content of pulps, as compared at 100 Canadian Standard Freeness, made by spraying shredded chips with sodium sulphite, heating at about 100° C. for various periods of time from 0 to 80 minutes and then pulping with a disc refiner. The burst factor rises from 16.0 to 28.0 with 10 minutes steaming, further increasing to 31.5 at 30 minutes and remaining unchanged at 80 minutes steaming. The debris content, the coarse material which must be removed before the pulp is used, was 5.6% in the absence of heating; 1.22% after 10 minutes heating; 0.56% after 30 minutes heating; and dropped slightly to 0.41% for 80 minutes heating. The heating stage of our process may also be done by steaming at supra-atmospheric pressures. We have found that steaming for 2 minutes at 142° C. (corresponding to about 40 psig. steam pressure) gives substantially the same results as steaming at atmospheric pressure for 30 minutes. Other time-temperature combinations may be used within the temperature range of 80° to 165° C., and the time range of 80 to 0.5 minutes. It is, however, a particular advantage of our process that the thermal reaction step can be done by simple steaming in an open container. Other processes require pressurized vessels which are expensive to build and require pressure lock means through which the wood is introduced and removed. Such pressure locks are usually either screw presses which form a dense plug of ingoing (or outgoing) wood material to contain the steam pressure, or are vaned rotary valves. Both mechanisms are known by the industry to be high maintenance cost units and it is an important feature of our process that the necessary heating step can, if desired, be done in a simple, open tower and that pressure locks are therefore not needed.

While we prefer to do the thermal reaction step in an open vessel at about 100° C. and may do it in a supra-atmospheric vessel at temperatures in the range of 125° C. to 165° C., this step of the process of our invention may also be done at intermediate temperatures in the 100° C. to 125° C. range using heating times of 30 minutes or more to about 2 minutes. While technically feasible, the use in our process of the 100° C. to 125° C. range shares the disadvantage of the range above 125° C. of needing pressure vessels and pressure lock means and has the added disadvantage of requiring larger heating vessels because of the longer heating time required. Thus, while still falling within the scope of our invention, it will generally be less attractive commercially than either the 80° to 100° C. range or the 125° to 165° C. range.

Following the foregoing processing, the treated wood substance is fed to a disc refiner for further comminution to the degree wanted for the process in which the product pulp is to be used. Any of the commercially available disc refiners used in making refiner mechanical pulp may be used in this step and the comminution may be effected by one, or by plural, passes through disc refiners. Where pulp so made is to be used as a single furnish pulp for making newsprint, energy input at the disc refiner will ordinarily be in the range of 85 to 100 horsepower days per oven dry ton or pulp—the same range used in making pulps for newsprint by the refiner mechanical and thermomechanical pulping processes.

Figure 3:
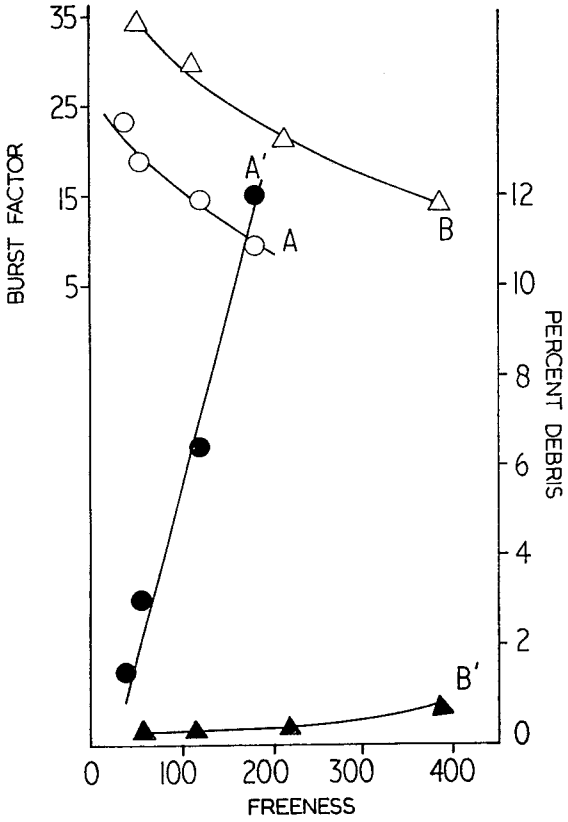
FIG. 3 shows a comparison between the present process and the known refiner mechanical process, showing improvement in burst factor and debris content against freeness.

The benefits of the process of our invention, as compared to the usual refiner mechanical pulping process, are available over a wide range of degrees of refining as evidenced in FIG. 3. A single lot of chips were divided into two parts. One part was pulped by the refiner mechanical process, the second by the process of our invention. Samples from each process were taken after various degrees of refining action. The burst factors and debris contents of these pulps are shown in FIG. 3 plotted against their respective freenesses. In FIG. 3, Curve A gives the burst factors and A′ the debris contents of the refiner mechanical pulps; B and B′ give comparable data for the pulps made by our process. Over the coextensive part of their freeness ranges, the burst factor for the pulp of our process is from 236% to 172% that of the conventional pulp while the debris content is only 2.0% to 1.3%.

Best refining stage results are obtained when the steamed material is processed at relatively high consistency. Consistency of the material entering the refiner is preferably in the range of 15% to 25%, and the consistency as it emerges from between the refiner discs is preferably in the range of 18% to 55%. It will be understood that the energy applied to the pulp by the refiner is very largely converted into heat and causes evaporation of water from the material being refined; material being discharged from the refiner discs will therefore be of higher consistency than when entering, assuming no water is added during refining for other purposes.

The superior pulp quality produced by our process is not simply the effect of the summing of the individual effects of the individual steps of the process but is produced by the synergistic effect of their combination in proper sequence. This is shown by comparison of the results of a number of tests in which some, or all, of the steps of our process were put together in different sequences. The effects of the different processing conditions are indicated by the burst factors and the debris contents of the pulps, as interpolated at 100 freeness, given in Table IV.

In Table IV, shred refers to the step of shredding chips as herein before described; refine means the previously described step of comminution in a disc refiner; stem refers to the heating of the wood substance by direct steaming at atmospheric pressure for 30 minutes; add sulphite is the step in our process by which a sodium sulphite solution is dispersed over the wood material.

TABLE IV

| Test No. | Treatment & Sequence | Pulp Test at 100 CSF Burst Factor | Dubris |
|---|---|---|---|
| 1 | Shred: refine | 16.9 | 2.8 |
| 2 | Shred: steam: refine | 16.4 | 5.5 |
| 3 | Shred: steam: add sulphite: refine | 20.7 | 4.6 |
| 4 | Shred: add sulphite: steam: refine | 29.0 | 0.65 |

Comparison of tests Nos. 1 and 2 shows no strength (burst factor) benefit from the added steaming step in test No. 2 and an apparently large increase in the debris content. When sulphite is added to shredded and steamed material before refining (2 vs 3), there is a modest increase in burst factor and a small drop in debris content. Comparing 4 with 3, it is clear that reversing the order of sulphite addition and steaming has, for 4, given a substantial strength increase and a major reduction in debris content. Comparison of Tests Nos. 1 and 4 show the large strength improvement and debris content reduction resulting from the use in proper sequence of all the steps of our process.

The process of our invention will be further described by specific examples which follow. While the exact steps used were of a semi-batch nature as made necessary by the available facilities, it will be apparent that each step can be readily adapted to a continuous form and that the successive steps can readily be linked together into a continuous system for commercial scale use of the process.

EXAMPLE 1

A batch of mixed spruce and balsam chips were divided into two parts. One part was shredded by a single pass through a Sprout Waldron 12″ single disc refiner furnished with devil tooth plates of pattern C-2975. Five hundred milliliters of sodium sulphite solution of 15% concentration was then sprayed on the 1300 grams (dry basis) of shredded chips with hand mixing. The chemically treated wood shreds were then placed in wire mesh baskets and put into an open container to which steam was added to bring the contents to a temperature of 90° to 100° C. This temperature was maintained for 30 minutes. The steamed shredded material was then passed through the 12″ Sprout Waldron refiner now equipped with D2A508 and D2A502 pattern plates. Refining was done at about 25% feed consistency. The material was passed through the refiner a sufficient number of times to produce pulp in the desired range of freeness. Samples taken from the pulp after the last three passes were tested for the properties listed in Table II. Test values of the various properties were plotted against the corresponding Canadian Standard Freeness of the samples and, from the trend lines, the values of the various properties which would be attained at a freeness of 100 were read. This data handling procedure permits comparing the properties of pulps made by different processes on a common base. The properties of the pulps made as described above and interpolated to 100 freeness are given in column B of Table II.

The second part of the batch of chips was processed exactly as was the first except that after shredding no sodium sulphite was added and the shredded material was not steamed. The pulp, thus, was made by the normal refiner mechanical pulping process. Pulp properties obtained, as interpolated to 100 freeness, are given in column A of Table II.

TABLE II

| | A | B |
|---|---|---|
| Burst factor (1) | 14.4 | 28.2 |
| Tear factor (1) | 79 | 89 |
| Bulk, ml./gm. (1) | 3.82 | 2.62 |
| Debris content, % | 12.8 | 0.5 |
| Brightness, % (1) | 51.0 | 59.3 |
| Net breaking length, meters | 187 | 270 |
| Yield on dry wood, % | 95.3 | 95.3 |
| Sodium sulphite in pulp, % | 0 | 4.7 |

Pulp tests marked (1) were done according to the standard methods of the Technical Section, Canadian Pulp and Paper Association. Debris content is a measure of unwanted, oversize material in the pulp measured as the percentage of residue on a screen having 0.006" wide slots after exhaustive washing. Wet breaking length is a measure of the wet strength of the pulp and relates to the ability of a wet paper sheet to run on a paper machine without breaking: The test used is not standard but was consistently used for all pulps to give test values showing their relative strengths in a wet condition.

It will be apparent that our process (column B) has given a notably superior product as compared to the product of the straight refiner mechanical pulping process (column A). The product of our process is very nearly twice as strong in burst, has an appreciably better tearing strength, does not have the unwanted high bulk of the refiner mechanical pulp, has a very much reduced debris content, is brighter and has been given these much improved properties without loss in yield.

EXAMPLE 2

The effects of our process when applied to several species of hardwood chips are demonstrated by this example. The wood species used were: Yellow birch, white birch and aspen. Chips from each species of wood were processed exactly as described in Example 1 except that three sets of pulp were made from each wood. These were: (A) Refiner mechanical pulp without addition of sodium sulphite and without steaming: (B) Pulp made according to our process using a moderate rate of sodium sulphite addition; (C) Pulp made according to our process using a higher rate of sodium sulphite addition. Qualities of the resultant pulps are given in Table III interpolated, as previously described, to values at 100 freeness.

TABLE III

| | Yellow Birch | | | White Birch | | | Aspen | | |
|---|---|---|---|---|---|---|---|---|---|
| | A | B | C | A | B | C | A | B | C |
| Burst factor | 4.0 | 8.2 | 9.7 | 5.8 | 9.1 | 9.7 | 7.2 | 13.0 | 14.5 |
| Tear factor | 31 | 32 | 41 | 27 | 30 | 32 | 48 | 46 | 47 |
| Bulk, ml./gm. | 3.69 | 3.09 | 3.03 | 3.2 | 2.78 | 2.66 | 3.22 | 2.43 | 2.15 |
| Debris content, % | 7.1 | 0.6 | 0.1 | 3.2 | 0.2 | 0.2 | 7.3 | 0.3 | 0.2 |
| Brightness, % | 45.0 | 49.0 | 51.5 | 47.5 | 52.4 | 53.8 | 58.5 | 59.8 | 54.8 |
| Wet Breaking Length, meters | 108 | 131 | 158 | 115 | 140 | 160 | 130 | 178 | 210 |
| Yield on dry wood, % | 95.2 | 95.2 | 93.7 | 95.5 | 95.1 | 94.7 | 96.4 | 95.0 | 94.4 |
| Sodium sulphite in pulp, % | 0 | 1.93 | 5.97 | 0 | 2.08 | 6.40 | 0 | 2.77 | 6.77 |

It is apparent that these hardwoods have responded to our process in the same manner and to essentially the same relative degree as did the softwood of Example 1. The apparently reduced brightness of aspen pulp C is thought to be the result of testing error.

It will be apparent that the greater part of the pulp quality improvement given by our process is had in the B column sampes where about 2% of sodium sulphite was available to the wood.

Use of about 6% sulphite, as in column C, has given a modest further improvement in pulp properties at the expense of higher chemical cost and a small reduction in yield.

DATA FOR FIGS. 4, 5, 6, and 7
PULP PROPERTIES AT 100 FREENESS

| pH of Treating Liquor | Untreated | 3.7 | 5.6 | 7.5 | 10.4 | 12.2 | 13.0 |
|---|---|---|---|---|---|---|---|
| Burst factor | 12.0 | 14.8 | 14.8 | 22.9 | 26.8 | 30.2 | 38.7 |
| % Debris | 18.3 | 11.0 | 12.0 | 1.7 | 0.79 | 0.57 | 0.45 |
| Brightness, % | 51.0 | 49.2 | 53.1 | 49.0 | 55.0 | 55.1 | 34.0 |
| Pulp Yield, % | 96.2 | 95.3 | 95.5 | 93.0 | 93.7 | 92.4 | 83.3 |

DATA FOR FIGS. 8, 9, and 10
PULP PROPERTIES AT 100 FREENESS

| $Na_2SO_3$ added as % of O.D. Wood | 0 | 1 | 2 | 4 | 10 |
|---|---|---|---|---|---|
| % Debris | 16.3 | 8.7 | 7.7 | 2.3 | 0.5 |
| Burst Factor | 12.0 | 15.0 | 16.3 | 22.2 | 29.6 |
| % Yield Loss | 3.8 | 4.1 | 4.0 | 4.5 | 6.0 |

We claim:

1. A process of making an improved refiner mechanical pulp from wood particles, said improved refiner mechanical pulp being capable of being used in competitive quality newsprint without the addition of chemical pulp, having a lower debris and shive content, a lower bulk, and a higher brightness, without the use of bleaching chemicals, than refiner mechanical pulp made by a conventional refiner mechanical pulping process, which comprises:

(a) wetting the surfaces of said particles by dipping them into or spraying onto said surfaces a solution of a sulphite salt of an alkali metal to add an amount of said alkali metal salt within the range of 1% to 10% of the oven dry weight of said particles, said solution having a pH within the range of 7 to 12.5; then (b) steam heating, by adding steam directly thereto, the sulphite salt solution-bearing particles, after draining any excess solution therefrom, to a temperature within the range between 80° C. and 165° C. and holding the particles for a time varying from 0.5 to 80 minutes, said particles not being immersed in liquid subsequent to said draining and prior to completion of steam heating and holding; and (c) passing the particles, after the period of steam heating, through a disc refiner to produce refiner mechanical pulp.

2. The process of claim 1 in which the alkali metal sulphite salt is sodium sulphite.

3. The process of claim 1 in which said particles are wood chips.

4. The process of claim 1 wherein the temperature to which said alkali metal sulphite salt solution-bearing particles are steam heated is within the range between 80° and 100° C., and said particles are held within that temperature range for a period of about 2 to 80 minutes.

5. The process of claim 4 wherein said particles are held within said temperature range for a period of 10 to 80 minutes.

6. The process of claim 4 wherein said particles are held within said temperature range for a period of 15 to 80 minutes.

7. The process of claim 1 in which the time range is 5 minutes to 0.5 minutes.

8. The process of claim 1 in which any sulphite salt solution draining from wood particles during the heating period is separated from the heated particles, and fortified with concentrated sulphite solution for use in further treating particles.

9. The process of claim 1 wherein the amount of alkali metal salt ranges from 1% to less than 8% of the oven dry weight of said particles.

10. A process for making an improved refiner mechanical pulp from wood chips, said improved refiner mechanical pulp being capable of being used in competitive quality newsprint without the addition of chemical pulp, having a lower debris and shive content, a lower bulk and a higher brightness, without the use of bleaching chemicals, than refiner mechanical pulp made by a conventional refiner mechanical pulping process, comprising:

(a) comminuting said wood chips by splitting them along the wood grain to make smaller particles;

(b) wetting the surfaces of said particles by dipping them into or spraying onto said surfaces a solution of a sulphite salt of an alkali metal to add an amount of said alkali metal salt within the range of 1% to 10% of the oven dry weight of said particles, said solution having a pH within the range of 7 to 12.5; then (c) steam heating, by adding steam directly thereto, the sulphite salt solution-bearing particles, after draining any excess solution therefrom, to a temperature within the range between 80° C. and 165° C. and holding the particles for a time varying from 0.5 to 80 minutes, said particles not being immersed in liquid subsequent to said draining and prior to completion of steam heating and holding; and (d) passing the particles, after the period of steam heating, through a disc refiner to produce refiner mechanical pulp.

11. The process of claim 10 in which the alkali metal sulphite salt is sodium sulphite.

12. The process of claim 11 wherein the pH of the sulphite salt solution is about 12.

13. The process of claim 10 in which the wood chips are split predominantly into particles having dimensions in the cross grain direction of not over four millimeters.

14. The process of claim 10 wherein the temperature is within the range between 80° C. and 100° C. and wherein the particles are held within that temperature range for a period of about 2 to 80 minutes.

15. The process of claim 14 in which the alkali metal sulphite salt is sodium sulphite.

16. The process of claim 15 wherein both the steam heating and refining steps are carried out at atmospheric pressure.

17. The process of claim 14 in which the wood chips are split predominantly into particles having dimensions in the cross grain direction of not over four millimeters.

18. The process of claim 17 wherein the temperature to which said alkali metal sulphite salt solution-bearing particles are steam heated is within the range of 85° 100° C. and said particles are held within the range for about 30 minutes.

19. The process of claim 14 wherein the alkali metal sulphite salt is added in an amount in the range of 2 to 10% of the oven dry weight of the chips.

20. The process of claim 14 in which any sulphite salt solution draining from the particles during the heating period is separated from the heated particles, and fortified with concentrated sulphite solution for use in further treating particles.

21. The process of claim 14 wherein cooling water is added to the particles after the heating step and before passing the particles through the refiner.

22. The process of claim 14 wherein the wetting step is carried out by spraying the solution onto the particles.

23. The process of claim 10 wherein said wood chips are comminuted predominantly by splitting them along the wood grain predominantly into particles having dimensions in the cross grain direction of not over four millimeters, and the alkali metal sulphite salt solution-bearing particles are steam heated under superatmospheric pressure to a temperature within the range between 125° C. and 165° C. and holding said particles within that temperature range for a period of 0.5 to 20 minutes.

24. The process of claim 23 in which the alkali metal sulphite salt is sodium sulphite.

25. The process of claim 23 wherein the alkali metal sulphite salt solution-bearing particles are held within said temperature range for about 2 minutes.

26. The process for making an improved refiner mechanical pulp from wood particles, said improved refiner mechanical pulp being capable of being used in competitive quality newsprint without the addition of chemical pulp, having a lower debris and shive content, a lower bulk and a higher brightness, without the use of bleaching chemicals, then refiner mechanical pulp made by a conventional refiner mechanical pulping process, comprising:

(a) spraying a solution of a sulphite salt of an alkali metal onto the surfaces of said particles to wet them and to add said sulphite salt in an amount of about 1% to about 10% of the oven dry weight of said particles, said solution having a pH of about 7 to about 12.5; then (b) steam heating, by adding steam directly thereto, the sulphite salt solution-bearing particles, after draining any excess solution therefrom, to a temperature range between about 80° C. and about 165° C. and holding the particles for a time varying from 0.5 to 80 minutes, said particles not being immersed in liquid subsequent to said draining and prior to completion of steam heating and holding; and (c) thereafter passing said particles through a disc refiner to produce refiner mechanical pulp.

27. A process for making an improved refiner mechanical pulp from wood chips, said improved refiner mechanical pulp being capable of being used in competitive quality newsprint without the addition of chemical pulp, having a lower debris and shive content, a lower bulk and a higher brightness, without the use of bleaching chemicals, than refiner mechanical pulp made by a conventional refiner mechanical pulping process, comprising:

(a) comminuting the wood chips by splitting them along the wood grain thereof to make smaller particles;

(b) spraying a solution of a sulphite salt of an alkali metal onto the surfaces of said particles to wet them and to add said sulphite salt in an amount of about 1% to about 10% of the oven dry weight of said particles, said solution having a pH of about 7 to 12.5; then (c) steam heating, by adding steam directly thereto, the sulphite salt solution-bearing particles, after draining any excess solution therefrom, to a temperature ranging between about 80° C. and about 165° C. and holding the particles for a time varying from 0.5 to 80 minutes, said particles not being immersed in liquid subsequent to said draining and prior to completion of steam heating and holding; and (d) thereafter passing said particles through a disc refiner to produce refiner mechanical pulp.

28. A process for making an improved refiner mechanical pulp from wood chips, said improved refiner mechanical pulp being capable of being used in competitive quality newsprint without the addition of chemical pulp, having a lower debris and shive content, a lower bulk and a higher brightness, without the use of bleaching chemicals, than refiner mechanical pulp made by a conventional refiner mechanical pulping process, comprising:

(a) comminuting the wood chips predominantly by splitting them along the wood grain thereof to make particles having dimensions in the cross grain direction of not over four millimeters;

(b) wetting said particles by spraying them with a solution of a sulphite salt of an alkali metal to add said sulphite salt in an amount of about 1% to about 10% of the oven dry weight of said particles, said solution having a pH of about 7 to about 12.5; then (c) steam heating, by adding steam directly thereto, the sulphite salt solution-bearing particles, after draining any excess solution therefrom, to a temperature ranging between about 85° C. and about 100° C. and holding the particles within that temperature range for about 30 minutes, said particles not being immersed in liquid subsequent to said draining and prior to completion of steam heating and holding; and (d) thereafter passing said particles through a disc refiner to produce refiner mechanical pulp.

29. A process for making an improved refiner mechanical pulp from sawdust or shavings, said improved refiner mechanical pulp having lower debris and shive contents, lower bulk and higher brightness, without the use of bleaching chemicals, than refiner mechanical pulps made from sawdust or shavings by a conventional refiner mechanical pulping process, comprising:

(a) wetting said sawdust or shavings by spraying them with a solution of a sulphite salt of an alkali metal to add said sulphite salt in an amount of about 1% to about 10% of the oven dry weight of said sawdust or shavings, said solution having a pH of about 7 to about 12.5; then (b) steam heating, by adding steam directly thereto, the sulphite salt solution-bearing sawdust or shavings, after draining any excess solution therefrom, to a temperature ranging between about 85° C. and 100° C. and holding the sawdust or shavings within that temperature range for about 2 to about 80 minutes, said particles not being immersed in liquid subsequent to said draining and prior to completion of steam heating an holding; and (c) thereafter passing said sawdust or shavings through a disc refiner to produce refiner mechanical pulp.

30. A process for making an improved refiner mechanical pulp from sawdust or shavings, said improved refiner mechanical pulp having lower debris and shive contents, lower bulk and higher brightness, without the use of bleaching chemicals, than refiner mechanical pulps made from sawdust or shavings by a conventional refiner mechanical pulping process, comprising:

(a) wetting said sawdust or shavings by dipping the into or spraying onto them a solution of a sulphite salt of an alkali metal to add said sulphite salt in an amount of about 1% to about 10% of the oven dry weight of said sawdust or shavings, said solution having a pH of about 7 to 12.5; then (b) steam heating, by adding steam directly thereto, the sulphite salt solution-bearing sawdust or shavings, after draining any excess solution therefrom, to a temperature ranging between about 80° C. and 165° C. and holding the sawdust or shavings within that temperature range for about 0.5 to about 80 minutes, said sawdust or shavings not being immersed in liquid subsequent to said draining and prior to completion of steam heating and holding; and (c) thereafter passing said sawdust or shavings through a disc refiner to produce refiner mechanical pulp.

* * * * *